US008731423B2

(12) United States Patent
Arakawa

(10) Patent No.: US 8,731,423 B2
(45) Date of Patent: May 20, 2014

(54) IMAGE FORMING APPARATUS AND CONTROL DEVICE AND CONTROL METHOD OF FIXING DEVICE

(75) Inventor: Masaya Arakawa, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 201 days.

(21) Appl. No.: 13/288,794

(22) Filed: Nov. 3, 2011

(65) Prior Publication Data

US 2012/0183317 A1 Jul. 19, 2012

Related U.S. Application Data

(60) Provisional application No. 61/434,371, filed on Jan. 19, 2011.

(51) Int. Cl.
*G03G 15/00* (2006.01)
*G03G 15/20* (2006.01)

(52) U.S. Cl.
USPC ..... 399/67; 399/45; 399/69; 399/70; 399/82

(58) Field of Classification Search
USPC ..... 399/45, 67, 70, 82, 400
See application file for complete search history.

(56) References Cited

U.S. PATENT DOCUMENTS 5,758,228 A * 5/1998 Hirose et al. ..... 399/70
6,308,022 B1 * 10/2001 Sasai ..... 399/70
6,876,823 B2 * 4/2005 Kojima et al. ..... 399/69
6,987,936 B2 * 1/2006 Satoh et al. ..... 399/88
6,999,692 B2 * 2/2006 Shimura et al. ..... 399/69
7,035,565 B2 * 4/2006 Takahashi et al. ..... 399/70
7,065,309 B2 * 6/2006 Sato ..... 399/69
7,088,934 B2 * 8/2006 Lee ..... 399/67
7,120,372 B2 * 10/2006 Kim et al. ..... 399/70
7,136,089 B2 * 11/2006 Able et al. ..... 347/262
7,164,870 B2 * 1/2007 Satoh ..... 399/69
7,336,405 B2 * 2/2008 Dan ..... 358/503
7,437,086 B2 * 10/2008 Ono ..... 399/38
7,605,931 B2 * 10/2009 Sato et al. ..... 358/1.14
2003/0095807 A1 * 5/2003 Fujimori et al. ..... 399/69
2004/0131375 A1 * 7/2004 Lee ..... 399/69
2004/0234286 A1 * 11/2004 Takahashi ..... 399/53
2005/0158063 A1 * 7/2005 Mizuno ..... 399/45
2005/0214013 A1 * 9/2005 Gilmore ..... 399/69
2006/0077418 A1 * 4/2006 Nakajima et al. ..... 358/1.14
2006/0198646 A1 * 9/2006 Funabiki et al. ..... 399/45

(Continued)

FOREIGN PATENT DOCUMENTS

JP 11258943 A * 9/1999
JP 2007-003992 1/2007
JP 2007-193165 8/2007
JP 2010-128146 6/2010

*Primary Examiner* — Walter L Lindsay, Jr.
*Assistant Examiner* — David Bolduc
(74) *Attorney, Agent, or Firm* — Patterson & Sheridan, L.L.P.

(57) ABSTRACT

An image forming apparatus includes: an image forming section including a fixing device configured to fix an image on a sheet; an acquiring section configured to acquire setting information of printing target data; a determining section configured to determine a first time on the basis of the setting information acquired by the acquiring section; and an output section configured to output a control signal to the fixing device to set a heat accumulation time of the fixing device to the first time determined by the determining section.

17 Claims, 3 Drawing Sheets

(56) References Cited

U.S. PATENT DOCUMENTS

| | | | | |
|---|---|---|---|---|
| 2006/0216052 | A1* | 9/2006 | Bartley et al. | 399/70 |
| 2007/0086817 | A1* | 4/2007 | Kato et al. | 399/388 |
| 2007/0098431 | A1* | 5/2007 | Sugiyama | 399/88 |
| 2007/0201891 | A1* | 8/2007 | Cho | 399/67 |
| 2008/0145087 | A1* | 6/2008 | Itou | 399/70 |
| 2008/0199198 | A1* | 8/2008 | Nishi | 399/69 |
| 2008/0232834 | A1* | 9/2008 | Tsukamura et al. | 399/45 |
| 2008/0267644 | A1* | 10/2008 | Murakami | 399/45 |
| 2009/0010662 | A1* | 1/2009 | Naoi et al. | 399/44 |
| 2009/0060553 | A1* | 3/2009 | Okabayashi | 399/70 |
| 2009/0190949 | A1* | 7/2009 | Hamahashi et al. | 399/101 |
| 2009/0297199 | A1* | 12/2009 | Yamashina et al. | 399/70 |
| 2009/0317102 | A1* | 12/2009 | Hasegawa et al. | 399/45 |
| 2010/0034547 | A1* | 2/2010 | Swing et al. | 399/69 |
| 2010/0104307 | A1* | 4/2010 | Shinyama | 399/68 |
| 2010/0196039 | A1* | 8/2010 | Ono | 399/69 |
| 2010/0232818 | A1* | 9/2010 | Kunii | 399/44 |
| 2010/0303522 | A1* | 12/2010 | Kodama | 399/323 |
| 2011/0217063 | A1* | 9/2011 | Noguchi | 399/70 |
| 2011/0229180 | A1* | 9/2011 | Saito | 399/69 |
| 2011/0235133 | A1* | 9/2011 | Saiki | 358/474 |
| 2011/0262159 | A1* | 10/2011 | Takeuchi et al. | 399/44 |

* cited by examiner

IMAGE FORMING APPARATUS AND CONTROL DEVICE AND CONTROL METHOD OF FIXING DEVICE

CROSS-REFERENCE TO RELATED APPLICATIONS

This application is based upon and claims the benefit of priority from: U.S. provisional application 61/434371, filed on Jan. 19, 2011; the entire contents all of which are incorporated herein by reference.

FIELD

Embodiments described herein relate generally to a technique for controlling the operation of a fixing device included in an image forming apparatus.

BACKGROUND

If a printing job is generated when an image forming apparatus is in a sleep state, the image forming apparatus returns from the sleep state and performs a printing preparation operation (hereinafter referred to as pre-run). A period from the start of the pre-run until printing is actually executed mainly depends on time for warming a fixing unit (hereinafter, heat accumulation time).

In the past, when the image forming apparatus returns from the sleep state, irrespective of what kind of a printing job is performed next, the image forming apparatus always warms the fixing unit until a fixed time elapses.

DETAILED DESCRIPTION

In general, according to one embodiment, an image forming apparatus includes: an image forming section including a fixing device configured to fix an image on a sheet; an acquiring section configured to acquire setting information of printing target data; a determining section configured to determine a first time on the basis of the setting information acquired by the acquiring section; and an output section configured to output a control signal to the fixing device to set a heat accumulation time of the fixing device to the first time determined by the determining section.

A state of use of the image forming apparatus and a purpose of this embodiment are explained below. Inmost cases, an image forming apparatus used in an office processes a printing job for about one to two sheets. In this case, since the number of printed sheets is small, it is unnecessary to set a long time for pre-run. However, the image forming apparatus in the past performs heat accumulation for a fixing unit for a fixed period even if only a small number of sheets are printed. Since a printing job is not processed in this fixed period, the start of the printing job is delayed.

The image forming apparatus according to this embodiment changes a pre-run time during return from a sleep state on the basis of setting information such as the number of printed sheets and a job type to thereby suppress useless heat accumulation processing by the fixing unit to reduce a loss of energy. The image forming apparatus according to this embodiment reduces time until return from the sleep state to improve usability of a user.

Figure 1:
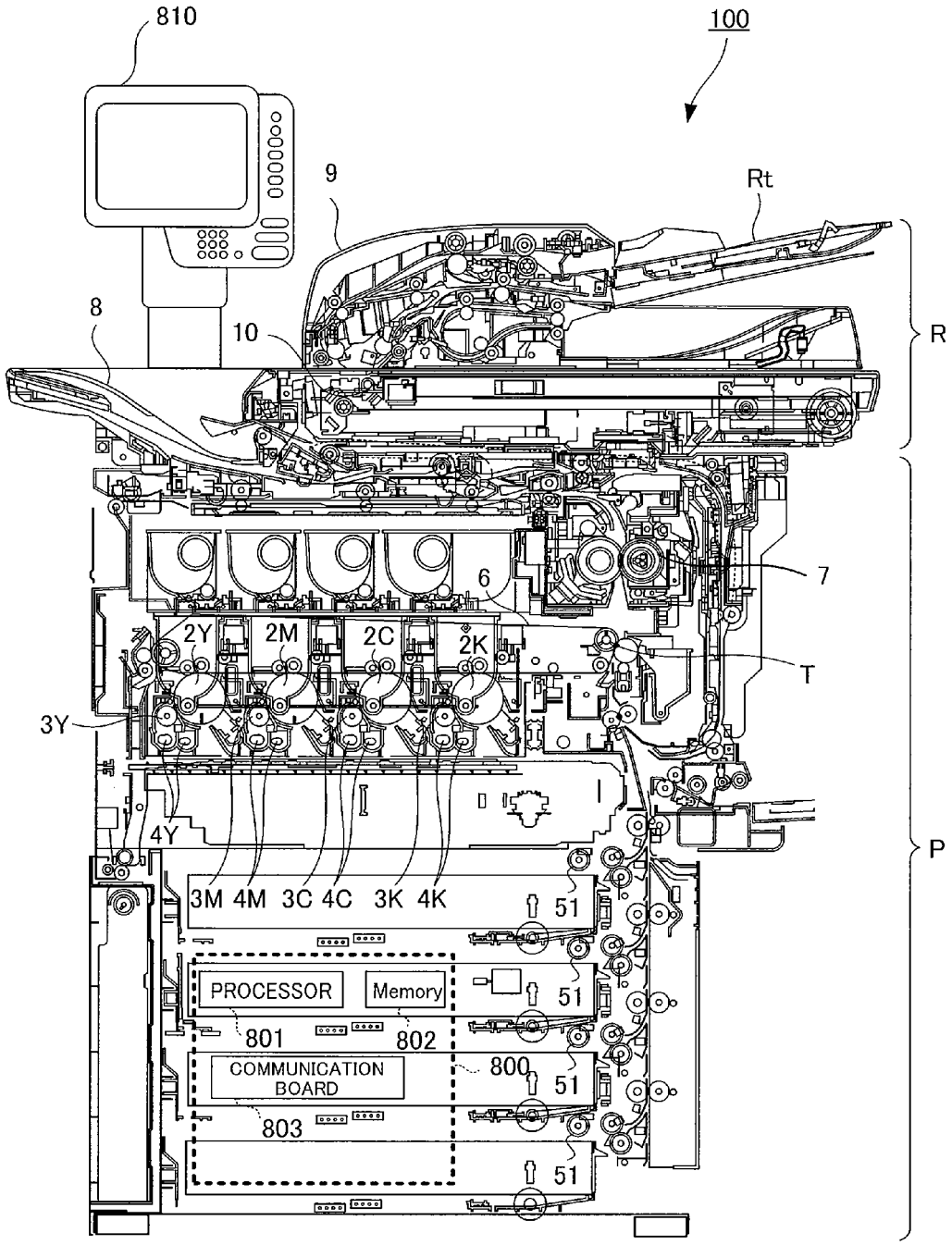
FIG. 1 is a diagram of a configuration example of an image forming apparatus according to an embodiment.

FIG. 1 is a longitudinal sectional view of a schematic configuration of the image forming apparatus (MFP: Multi Function Peripheral) according to this embodiment. As shown in FIG. 1, an image forming apparatus 100 according to this embodiment includes a reading section R and an image forming section P.

The reading section R includes a function of scanning and reading images of a sheet document and a book document. The reading section R includes a scanning optical system 10 including plural reflection mirrors and an image pickup element. The reading section R also includes an auto document feeder (ADF) 9 that can automatically feed an original document to a predetermined placing place. Images of an original document placed on a document tray Rt and automatically fed by the auto document feeder 9 and an original document placed on a not-shown document table are read by the scanning optical system 10.

The image forming section P includes a function of forming a developer image on a sheet on the basis of, for example, an image read from an original document by the reading section R or image data transmitted from an external apparatus to the image forming apparatus 100. The image forming section P includes photoconductive members 2Y to 2K, developing rollers 3Y to 3K, mixers 4Y to 4K, an intermediate transfer belt 6, a fixing device 7, and a discharge tray 8.

The image forming apparatus 100 includes a control board 800. The control board 800 includes a processor 801, a memory 802, and a communication board 803. The processor 801 is an arithmetic processing unit such as a CPU (Central Processing Unit) or an MPU (Micro Processing Unit) . The processor 801 has a role of performing various kinds of processing in the image forming apparatus 100. The processor 801 also has a role of realizing various functions by executing an arithmetic operation of computer programs stored in the memory 802 in advance.

The memory 802 has a role of storing various kinds of information and computer programs used in the image forming apparatus 100. The memory 802 includes a nonvolatile storage device such as an FROM (Flash Read Only Memory) or a hard disk drive or a volatile storage device such as an SRAM (Static Random Access Memory), a DRAM (Dynamic Random Access Memory, or a VRAM (Video RAM).

The communication board 803 includes a function of performing data transmission and reception to and from an external apparatus via a telephone line or a LAN (Local Area Network). The communication board 803 includes a network interface card (NIC) or a facsimile modem. The communication board 803 may include a terminal connectable to an external device such as an external hard disk drive or a USB (Universal Serial Bus) memory.

The image forming apparatus 100 includes a control panel 810. The control panel 810 receives an instruction and setting information from a user and displays processing content to the user.

An overview of copying is explained below as an example of processing in the image forming apparatus 100 according to this embodiment.

First, a sheet picked up by a pickup roller 51 is fed into a sheet conveying path. The sheet fed into the sheet conveying path is conveyed in a predetermined conveying direction by plural roller pairs.

Images of plural sheet documents continuously automatically fed by the auto document feeder 9 are read by the scanning optical system 10.

The control board 800 applies predetermined image processing to image data read from the original document by the reading section R. Therefore, electrostatic latent images of the data subjected to the image processing are formed on photoconductive surfaces of the photoconductive members 2Y, 2M, 2C, and 2K for transferring developer images of Y (yellow), M (magenta), C (cyan), and K (black) onto a sheet.

Subsequently, developers agitated by the mixers 4Y to 4K in respective developing devices are supplied to the photoconductive members 2Y to 2K, on which the electrostatic latent images are formed as explained above, by the developing rollers (so-called magnetic rollers) 3Y to 3K. Consequently, the electrostatic latent images formed on the photoconductive surfaces of the photoconductive members 2Y to 2K are visualized.

Developer images formed on the photoconductive members 2Y to 2K in this way are transferred onto a belt surface of the intermediate transfer belt 6 (so-called primary transfer). The developer images carried by the rotation of the intermediate transfer belt 6 are transferred onto the conveyed sheet in a predetermined secondary transfer position T.

The developer images transferred onto the sheet are heated and fixed to the sheet by the fixing device 7 . The sheet having the developer images heated and fixed thereon is conveyed through a conveying path by plural conveying roller pairs and sequentially discharged onto the discharge tray 8.

Figure 2:
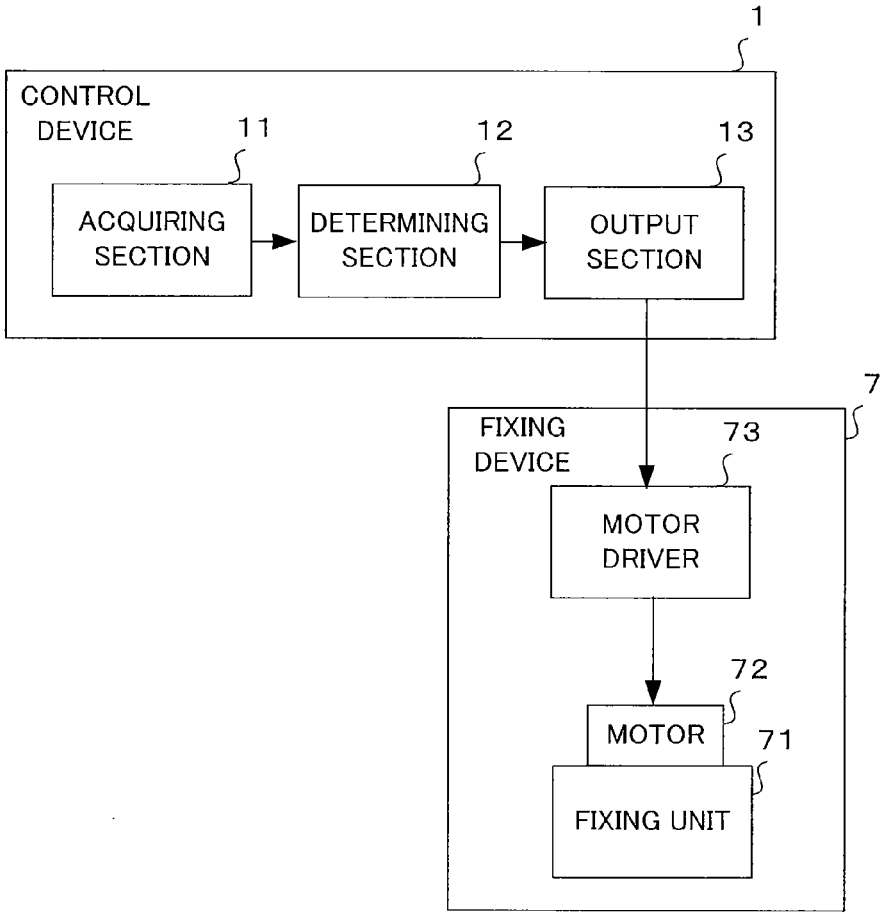
FIG. 2 is a block diagram of a configuration example of a control device and a fixing device according to the embodiment.

A configuration example of the fixing device 7 and a control device 1 configured to control the fixing device 7 is shown in a block diagram of FIG. 2.

The fixing device 7 includes a fixing unit 71 including a pair of a heating roller and a pressing roller, a motor 72, which is a driving source for the fixing unit 71, and a motor driver 73, which is a driving control circuit for the motor 72.

The control device 1 is a device configured to control the fixing device 7 and is mounted on the control board 800. The control device 1 includes an acquiring section 11, a determining section 12, and an output section 13. These units in the control device 1 shown in FIG. 2 are realized by the processor 801 executing an arithmetic operation of a computer program stored in the memory 802 in advance. The units may be implemented by ASICs (Application Specific Integrated Circuits). The acquiring section 11, the determining section 12, and the output section 13 according to this embodiment are explained as starting when the image forming apparatus 100 returns from a sleep state. However, this does not limit a form. The acquiring section 11, the determining section 12, and the output section 13 maybe started at any time, for example, when the fixing device 7 starts heat accumulation from a stopped state.

The acquiring section 11 includes the communication board 803. The acquiring section 11 acquires, from an external apparatus, image data (printing target data) and setting information, which is information concerning printing setting for the image data, such as a transmitted number of sheets, the number of printed sheets, and the number of printed copies. The acquiring section 11 receives a facsimile signal (printing target data) through a telephone line and generates setting information such as a transmitted number of sheets and the number of printed sheets. The external apparatus according to this embodiment is a personal computer or a facsimile transceiver. However, the external apparatus may be an external storage device such as a USB memory or an external hard disk drive.

The acquiring section 11 acquires document image data (printing target data) from the reading section R and acquires setting information of the document image data from a number-of-sheet counter included in the reading section R or from the control panel 810 (i.e., acquires setting information input by the user using the control panel 810). The acquiring section 11 acquires a job type of the printing job as setting information.

The determining section 12 determines a pre-run time (a first time) on the basis of the setting information such as the number of sheets and the job type acquired by the acquiring section 11. In this embodiment, a table in which the numbers of sheets and pre-run times are associated with each other is stored in the memory 802. The determining section 12 searches through the table using the number of sheets acquired by the acquiring section 11 to acquire a pre-run time. Besides this implementation, various implementations such as an implementation employing a formula for calculating a pre-run time using the number of sheets as a variable are conceivable. Determination processing performed by the determining section 12 is, for example, processing for deriving a value of a pre-run time and storing the value of the pre-run time in a predetermined area of the memory 802 and processing for passing the derived value of the pre-run time to processing in the next step.

The output section 13 outputs a control signal to the fixing device 7 to set the pre-run time, which is determined by the determining section 12, as a heat accumulation time of the fixing unit 71. The output section 13 outputs a motor driving start signal and outputs a stop signal after the pre-run time. The fixing device 7 continues to accumulate heat until the fixing device 7 receives an input of the stop signal after receiving an input of the driving start signal. Besides this method, an implementation may be adopted in which the output section 13 outputs the motor driving start signal and outputs a signal corresponding to the determined pre-run time. In this case, the motor driver 73 of the fixing device 7 controls a stop time. Besides the above, various implementations are conceivable.

The motor driver 73 receives an input of the control signal from the output section 13 and applies a driving current to the motor 72 using the control signal as a trigger. The motor 72 drives the fixing unit 71 with the driving current. The fixing unit 71 accumulates heat.

An operation example of the image forming apparatus 100 is explained with reference to a flowchart of FIG. 3.

The acquiring section 11 acquires setting information of image data such as the number of printed sheets, the number of copies, and a job type (ACT 1). In the case of facsimile reception, the acquiring section 11 generates the setting information using a default value and acquires the generated setting information.

The determining section 12 determines, from the information of the job type acquired in ACT 1, which of jobs such as facsimile reception, copy (processing for copying an original document using the reading section R), and printer output (processing for print from the external apparatus) the job is (ACT 2). If the job type is the facsimile reception (YES in ACT 2), the determining section 12 determines a pre-run time as 3 s (the unit s means second) (ACT 7). In the case of the facsimile printing, about one to two sheets are often printed. Therefore, the determining section 12 determines the pre-run time to be a short time. In this way, if the job type is the facsimile reception, the determining section 12 determines the pre-run time to be shorter than pre-run times in the other job types and, in this embodiment, determines the pre-run time to be the shortest.

Subsequently, if the job type is not the facsimile reception (NO in ACT 2) , the determining section 12 determines pre-run time according to the number of printed sheets (ACTS 3 to 11). Numerical values shown in ACTS 3 to 11 are numerical values in an example in which a heat accumulation amount of the fixing device 7 reaches an upper limit in pre-run for 30 s in design and are examples only. Processing in ACTS 3 to 11 is explained below.

If the number of sheets is smaller than five (YES in ACT 3), the determining section 12 determines the pre-run time as 3 s (ACT 7).

If the number of sheets is equal to or larger than five and smaller than ten (YES in ACT 4), the determining section 12 determines the pre-run time as 5 s (ACT 8).

If the number of sheets is equal to or larger than ten and smaller than twenty-five (YES in ACT 5), the determining section 12 determines the pre-run time as 10 s (ACT 9).

If the number of sheets is equal to or larger than twenty-five and smaller than fifty (YES in ACT 6), the determining section 12 determines the pre-run time as 20 s (ACT 10).

If the number of sheets is equal to or larger than fifty (NO in ACT 6), the determining section 12 determines the pre-run time as 30 s (ACT 11).

The output section 13 outputs a control signal to the motor driver 73 to set a heat accumulation time of the fixing device 7 to the time determined by the determining section 12 (ACT 12). The fixing device 7 receives an input of the control signal, whereby the fixing unit 71 accumulates heat for the pre-run time determined by the determining section 12 (ACT 13).

With the configuration for changing the heat accumulation time according to the number of sheets in this way, it is possible to reduce a loss of energy due to useless heat accumulation processing and reduce a return time from the sleep state. Therefore, a waiting time of the user is also reduced and usability is improved.

The implementation examples for determining a pre-run time on the basis of the number of sheets and the job type are explained above. Implementation examples for determining a pre-run time other than the implementation examples explained above are explained below. Plural implementation examples explained below may be combined with one another.

Implementation Example for Determining a Pre-Run Time on the Basis of Setting of Simplex Printing or Duplex Printing The setting information also includes information concerning in which of duplex printing and simplex printing sheets are printed. In the case of the duplex printing, the front side and the rear side of one sheet are printed. Therefore, the fixing device 7 needs a heat accumulation amount larger than that in the simplex printing by an amount for the rear side printing. An implementation that takes this into account can also be applied in this embodiment. Specifically, the acquiring section 11 acquires, as the setting information, information for distinguishing the simplex printing and the duplex printing (ACT 20 in FIG. 3). The determining section 12 determines, using the setting information, which of the duplex printing and the simplex printing the printing job is. In the case of the duplex printing, the determining section 12 determines a pre-run time again to set the pre-run time to time longer than the pre-run time determined in ACTS 7 to 11 in FIG. 3. In the example shown in FIG. 3, in the case of the duplex printing, a pre-run time is determined to be twice as long as that in the simplex printing with 30 s set as an upper limit in this embodiment (ACT 21 in FIG. 3). For example, if the number of sheets is smaller than five (YES in ACT 3), the pre-run time is 3 s in the simplex printing (ACT 7). However, in the duplex printing, the pre-run time is 6 s. If the number of sheets is equal to or larger than twenty-five and smaller than fifty (YES in ACT 6) , the pre-run time is 20 s in the simple printing (ACT 10). However, in the duplex printing, the pre-run time is the upper limit 30 s rather than 40 s.

The determining section 12 may determine a pre-run time on the basis of only a setting value of the simplex printing or the duplex printing. For example, the determining section 12 may determine, without taking into account the number of sheets, the pre-run time as 15 s if the printing job is the simplex printing and as 30 s if the printing job is the duplex printing.

Implementation Example for Determining a Pre-Run Time on the Basis of a Sheet Size In the setting information, sheet sizes such as the A4 size and the A3 size are set. As a sheet size is larger, the fixing device 7 needs to be heated for a longer time. The determining section 12 can also determine a pre-run time according to a sheet size.

Figure 3:
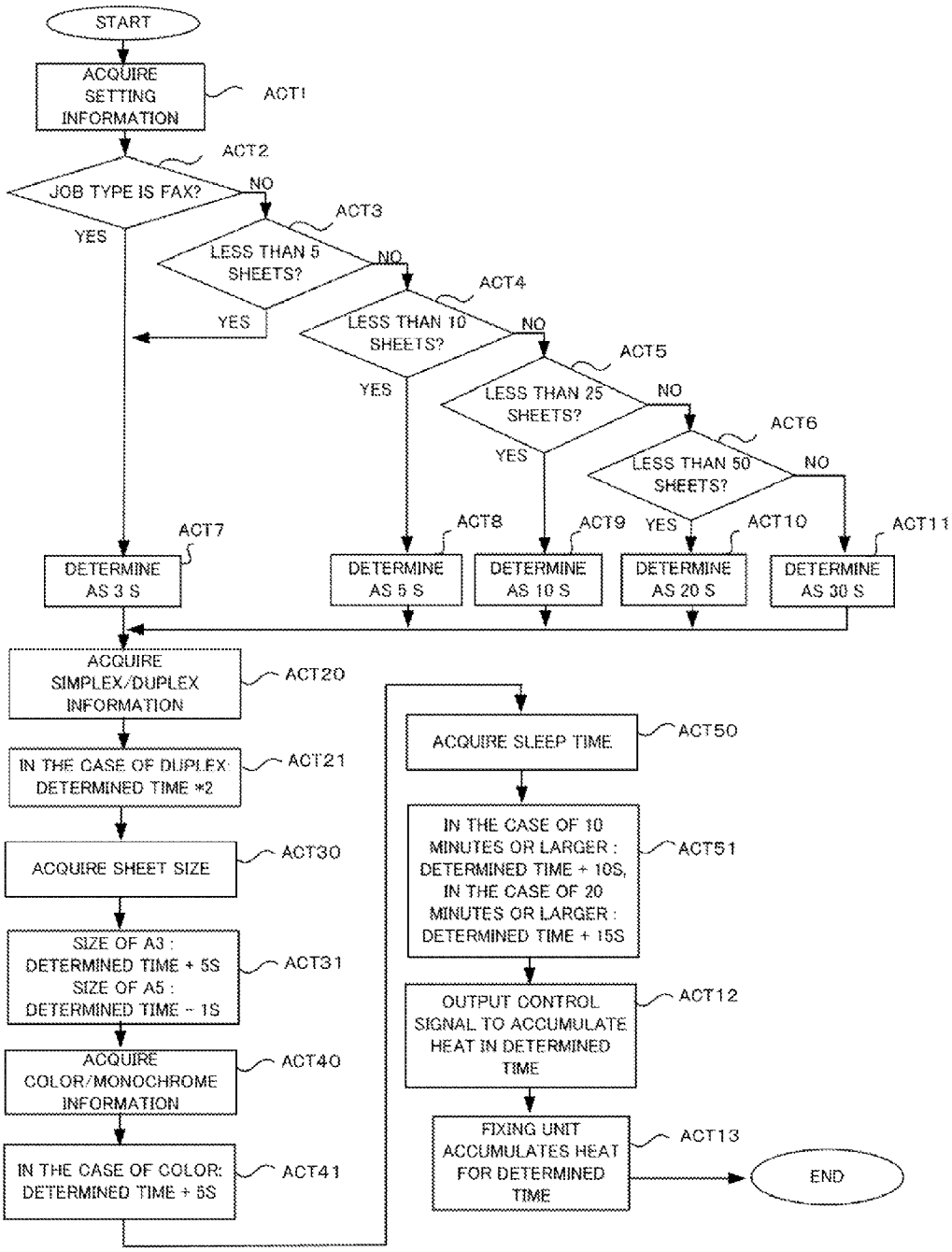
FIG. 3 is a flowchart for explaining an operation example of the image forming apparatus according to the embodiment.

The acquiring section 11 acquires information concerning a sheet size as the setting information (ACT 30 in FIG. 3). The determining section 12 determines a pre-run time such that a heat accumulation time is longer as the sheet size is larger. In the example shown in FIG. 3, if a sheet size of the printing job is the A3 size, the determining section 12 adds 5 s to the values determined in ACTS 7 to 11 (ACT 31 in FIG. 3). If the sheet size is the A5 size, the determining section 12 subtracts 1 s from the values determined in ACTS 7 to 11 (ACT 31 in FIG. 3). If the sheet size is the A4 size, the determining section 12 adopts the values in ACTS to 11 as they are without performing the addition and subtraction. The numerical values and the processing are examples only. Various methods are conceivable such as a method of multiplying a determined pre-run time with a coefficient defined in advance and recalculating a pre-run time, for example, multiplying the pre-run time with a coefficient 1.2 in the case of the A3 size and multiplying the pre-run time with a coefficient 0.8 in the case of the A5 size.

The determining section 12 may determine a pre-run time on the basis of only a setting value of a sheet size. For example, the determining section 12 may determine, without taking into account the number of sheets, the pre-run time as 30 s if the sheet size is A3, as 20 s if the sheet size is A4, and as 10 s if the sheet size is the A5 size or smaller.

Implementation Example for Determining a Pre-Run Time on the Basis of Distinction of Color Printing and Monochrome Printing A heat accumulation amount of the fixing device 7 may be smaller in monochrome printing than in color printing. Therefore, a pre-run time may be shorter in the monochrome printing. An implementation that takes this into account is also possible. Flag data for distinguishing the monochrome printing and the color printing is included in the setting information. The determining section 12 determines, using the flag data, whether the print processing is the monochrome printing or the color printing and recalculates a pre-run time on the basis of a result of the determination.

The acquiring section 11 acquires information for distinguishing the color printing and the monochrome printing as the setting information (ACT 40 in Fiq. 3). If the print processing is the monochrome printing, the determining section 12 adopts the pre-run times determined in ACTS 7 to 11 in FIG. 3 as they are. If the print processing is the color printing, the determining section 12 adds, for example, 5 s to the pre-run times determined in ACTS 7 to 11 and recalculates pre-run times (ACT 41 in Fiq. 3). The numerical values and the processing in this example are also examples only. As explained above, for example, a method of multiplying a pre-run time with a coefficient is also possible.

The determining section 12 may determine a pre-run time on the basis of only a setting value of the color printing or the monochrome printing. For example, the determining section 12 may determine, without taking into account the number of sheets, the pre-run time as 20 s if the printing job is the monochrome printing and as 30 s if the printing job is the color printing.

Implementation Example for Determining a Pre-Run Time on the Basis of a Sleep Time If the image forming apparatus 100 is in a sleep state, the fixing device 7 is stopped. As time when the fixing device 7 is stopped is longer, the temperature of the fixing unit 71 is closer to the outdoor temperature. Therefore, time necessary for causing the fixing device 7 to accumulate heat during return from the sleep state is longer. In this embodiment, an implementation that takes this into account is also applicable. Specifically, the determining section 12 measures time from the start until the end of the sleep state of the image forming apparatus 100 (ACT 50 in FIG. 3), and determines a pre-run time using the measured time. For example, if the sleep time is equal to or longer than ten minutes, the determining section 12 adds 10 s to the values determined in ACTS 7 to 11 (ACT 51 in FIG. 3). If the sleep time is equal to or longer than twenty minutes, the determining section 12 adds 15 s to the values determined in ACTS 7 to 11. (In these cases, 30 s is set as the upper limit as in the cases explained above.) The determining section 12 may measure a sleep time using a system clock included in the processor 801 or may use other timers.

The determining section 12 may determine a pre-run time on the basis of only the sleep time. For example, the determining section 12 determines, without taking into account the number of sheets, the pre-run time as, for example, 5 s if the sleep time is shorter than five minutes, as 10 s if the sleep time is equal to or longer than five minutes and shorter than ten minutes, as 20 s if the sleep time is equal to or longer than ten minutes and shorter than twenty minutes, and as 30 s if the sleep time is equal to or longer than twenty minutes.

As explained above, the determining section 12 determines a heat accumulation time of the fixing device 7 on the basis of the setting information such as a type of a job, the number of printed sheets, distinction of the simplex printing or the duplex printing, a sheet size, and distinction of the color printing or the monochrome printing. The determining section 12 measures a sleep time of the image forming apparatus 100 and determines a heat accumulation time of the fixing device 7 on the basis of the sleep time.

As explained above in detail, according to the technique described in this specification, it is possible to reduce electric power consumed by heat accumulation of a fixing device.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus comprising:

an image forming section including a fixing device configured to fix an image on a sheet;

an acquiring section configured to acquire setting information of printing target data, the setting information include a job type and a number of sheets on which the printing target data is to be fixed as the image;

a determining section configured to determine a heat accumulation time based on the setting information acquired by the acquiring section, the heat accumulation time being selected from a plurality of predetermined times, wherein the heat accumulation time is determined to be a shortest time of the plurality of predetermined times if the job type is a facsimile reception, and the heat accumulation time is determined to be the shortest time of the plurality of predetermined times if the job type is not the facsimile reception and the number of sheets is less than a predetermined number; and an output section configured to output a control signal to the fixing device to heat the fixing device for the heat accumulation time determined by the determining section.

2. The apparatus according to claim 1, wherein the acquiring section, the determining section, and the output section start when the image forming apparatus returns from a sleep state.

3. The apparatus according to claim 1, wherein the determining section determines the heat accumulation time is longer than the shortest time of the plurality of predetermined times, if the number of sheets on which the printing target data is to be fixed is larger than the predetermined number.

4. The apparatus according to claim 1, wherein the setting information acquired by the acquiring section includes information for distinguishing whether the printing target data is to be printed in simplex printing or duplex printing, and the determining section determines, if the printing target data is to be printed in duplex printing, the heat accumulation time to be longer than the heat accumulating time determined when the printing target data is to be printed in simplex printing.

5. The apparatus according to claim 1, wherein the setting information acquired by the acquiring section includes information concerning a sheet size, and the determining section determines, if the sheet size is larger than a predetermined size, the heat accumulation time to be longer than the heat accumulation time determined when the sheet size is equal to or smaller than a predetermined size.

6. The apparatus according to claim 1, wherein the setting information acquired by the acquiring section includes information for distinguishing in which of monochrome printing and color printing the printing target data is to be printed, and the determining section determines, if the printing target data is to be printed in color printing, the heat accumulation time to be longer than the heat accumulation time determined if the printing target data is to be printed in monochrome printing.

7. The apparatus according to claim 1, wherein the determining section measures a time from when the image forming apparatus enters a sleep state until the image forming apparatus returns from the sleep state, and determines the heat accumulation time on the basis of the measured time.

8. The apparatus according to claim 7, wherein the determining section determines, if the measured time is longer than a predetermined sleep time, the heat accumulation time to be longer than if the heat accumulation time determined if the measured time is less than or equal to the predetermined sleep time.

9. A control device of a fixing device, comprising:

an acquiring section configured to acquire setting information of printing target data, the setting information include a job type and a number of sheets on which the printing target data is to be fixed;

a determining section configured to determine a heat accumulation time based on the setting information acquired by the acquiring section, the heat accumulation time being selected from a plurality of predetermined times, wherein the heat accumulation time is determined to be a shortest time of the plurality of predetermined times if the job type is a facsimile reception, and the heat accumulation time is determined to be the shortest time of the plurality of predetermined times if the job type is not the facsimile reception and the number of sheets is less than a predetermined number; and an output section configured to output a control signal to a fixing device to heat the fixing device for the heat accumulation time determined by the determining section.

10. The device according to claim 9, wherein the control device is included in an image forming apparatus, and the acquiring section, the determining section, and the output section start when the image forming apparatus returns from a sleep state.

11. The device according to claim 9, wherein the determining section determines the heat accumulation time is longer than the shortest time of the plurality of predetermined times, if the number of sheets on which the printing target data is to be fixed is larger than the predetermined number.

12. The device according to claim 9, wherein the setting information acquired by the acquiring section includes information for distinguishing whether the printing target data is to be printed in simplex printing or duplex printing, and the determining section determines, if the printing target data is to be printed in duplex printing, the heat accumulation time to be longer than the heat accumulating time determined when the printing target data is to be printed in simplex printing.

13. The device according to claim 9, wherein the setting information acquired by the acquiring section includes information concerning a sheet size, and the determining section determines, if the sheet size is larger than a predetermined size, the heat accumulation time to be longer than the heat accumulation time determined when the sheet size is equal to or smaller than a predetermined size.

14. The device according to claim 9, wherein the setting information acquired by the acquiring section includes information for distinguishing in which of monochrome printing and color printing the printing target data is to be printed, and the determining section determines, if the printing target data is to be printed in color printing, the heat accumulation time to be longer than the heat accumulation time determined if the printing target data is to be printed in monochrome printing.

15. The device according to claim 9, wherein the control device is included in an image forming apparatus, and determining section measures a time from when the image forming apparatus enters a sleep state until the image forming apparatus returns from the sleep state, and determines, if the measured time is longer than a predetermined sleep time, the heat accumulation time to be longer than if the heat accumulation time determined if the measured time is less than or equal to the predetermined sleep time.

16. A control method of a fixing device, comprising:

acquiring setting information of printing target data, the setting information include a job type and a number of sheets on which the printing target data is to be fixed;

determining a heat accumulation time based on the acquired setting information, the heat accumulation time being selected from a plurality of predetermined times, wherein the heat accumulation time is determined to be a shortest time of the plurality of predetermined times if the job type is a facsimile reception, and the heat accumulation time is determined to be the shortest time of the plurality of predetermined times if the job type is not the facsimile reception and the number of sheets is less than a predetermined number; and outputting a control signal to the fixing device to heat the fixing device for the heat accumulation time determined by the determining section.

17. The method according to claim 16, further comprising:

determining the heat accumulation time is longer than the shortest time of the plurality of predetermined times, if the number of sheets on which the printing target data is to be fixed is larger than the predetermined number.

* * * * *